United States Patent [19]

Doyle

[11] 4,284,317

[45] Aug. 18, 1981

[54] ELECTRICAL WIRING CONNECTOR

[75] Inventor: Richard C. Doyle, Greenlawn, N.Y.

[73] Assignee: Slater Electric Inc., Glen Cove, N.Y.

[21] Appl. No.: 6,793

[22] Filed: Jan. 25, 1979

[51] Int. Cl.[3] ..... H01R 13/58

[52] U.S. Cl. ..... 339/103 R; 339/107

[58] Field of Search ..... 339/103, 107, 110 P, 339/196 A, 196 M, 206

[56] References Cited

U.S. PATENT DOCUMENTS

| | | | |
|---|---|---|---|
| 1,950,036 | 3/1934 | Preston | 174/46 |
| 1,984,181 | 12/1934 | French | 339/196 R |
| 2,425,679 | 8/1947 | Jackson | 339/142 |
| 2,542,609 | 2/1951 | Wyglendowski | 339/196 A |
| 2,869,102 | 1/1959 | Hubbell, Jr. | 339/101 |
| 3,137,536 | 6/1964 | Healy | 339/103 |
| 3,335,395 | 8/1967 | Smith | 339/107 |
| 3,718,890 | 2/1973 | Sheldon | 339/107 |
| 3,747,049 | 7/1973 | Cressman et al. | 339/107 |
| 3,784,961 | 1/1974 | Gartland, Jr. | 339/107 |
| 3,787,798 | 1/1974 | Carissimi et al. | 339/107 |
| 3,803,530 | 4/1974 | Lapraik | 339/36 |
| 3,829,819 | 8/1974 | Eckart | 339/44 R |
| 3,936,129 | 2/1976 | Guy | 339/103 R |
| 3,950,069 | 4/1976 | Wiley | 339/196 M |
| 4,006,958 | 2/1977 | Kramer et al. | 339/110 |
| 4,035,051 | 7/1977 | Guy | 339/103 R |

*Primary Examiner*—Neil Abrams

*Attorney, Agent, or Firm*—Morgan, Finnegan, Pine, Foley & Lee

[57] ABSTRACT

An angle cap electrical wiring connector contains a cable clamp which is removably fixedly mounted to the angle cap housing independent of the clamp tightening screws. The clamp includes an arcuate section which completes the circular cavity wall of the angle cap body housing the electrical wiring chamber. An expandable diaphragm extending between the arcuate section and the clamp closes access to the wiring chamber from the environment at all times, regardless of size of the power cable clamped to the angle cap. The clamping member, arcuate section and diaphragm are formed integrally as a single piece.

16 Claims, 5 Drawing Figures

ELECTRICAL WIRING CONNECTOR

BACKGROUND AND OBJECTS OF THE INVENTION

1. Field of the Invention

The present invention relates generally to electrical wiring plugs and connector devices, and to electrical connector devices known commercially as "angle caps" or angle plugs, in which the electrical power and grounding blades extend at a 90° angle from the direction in which the electrical power cable extends from the plug housing, and relates more particularly to certain new and useful improvements in such angle cap housings and in provisions for clamping the cable within the angle cap housing.

2. Description of the Prior Art

It has long been recognized that in certain circumstances it is desirable to orient the blades, and grounding plug where required, of an electrical plug at a right angle to the power cable so as to permit the cable to lie close to the wall in which the electrical outlet is mounted. A variety of such angle plug devices have been used or proposed, as shown, e.g., in U.S. Pat. Nos. 1,950,036; 1,984,181; 2,425,679; 2,542,609; 2,869,102; 3,137,536; 3,335,395; 3,718,890; 3,747,049; 3,784,961; 3,787,798; 3,803,530; 3,829,819; 3,936,129; 3,950,069; 4,006,958; 4,035,051.

However, in all previously known angle cap devices, it has been customary to provide the clamping mechanism for securing the electrical power cable to the angle cap housing as separate insert pieces which are held in place only by the clamp tightening screws which tighten the clamp member onto the cable. This construction has been found to be undesirable in that these separate pieces can be difficult and time-consuming to insert and/or remove and re-insert, they tend to become lost and, where more than one insert piece is utilized, require additional molding operations.

It has also heretofore been customary in angle cap devices that an open slot is formed between the wiring chamber and the cable clamping mechanism, which increases in size as the clamping parts are drawn down into clamping engagement with smaller-sized power cables. This construction is also highly undesirable for the reason that the open slot exposes the wiring chamber to the outside environment and creates a potential hazard to life as it permits inadvertent touching of live electrical parts.

3. Objects of the Invention

It is therefore an object of the present invention to provide a novel and improved electrical wiring connector device.

Another object of the present invention is to provide a novel and improved angle cap electrical wiring connector device.

Another object of the present invention is to provide a novel and improved clamping mechanism of utility especially in electrical wiring connector devices.

Another object of the present invention is to provide a novel and improved angle cap electrical wiring connector device having a cable clamping mechanism in which the wiring chamber is at all times completely closed to the surrounding environment.

Another object of the present invention is to provide a novel and improved angle cap electrical wiring connector device having a cable clamping mechanism, wherein the clamping mechanism is removably fixedly mounted to the angle cap housing independently of the clamp tightening devices.

Another object of the present invention is to provide a novel and improved angle cap electrical wiring connector device having a cable clamping mechanism, wherein the clamping mechanism includes an expandable diaphragm member which closes over the wiring chamber for all electrical power cable sizes secured to the angle cap.

Another object of the present invention is to provide a novel and improved angle cap electrical wiring connector device which includes an expandable diaphragm member covering the connection point between the wiring chamber and the electrical power cable.

Another object of the present invention is to provide a novel and improved angle cap electrical wiring connector device having a cable clamp and expandable diaphragm member which are removably fixedly mounted to the angle cap housing and are formed integrally as a single piece.

Another object of the present invention is to provide a novel and improved angle cap electrical wiring connector device having a cable clamping mechanism which is constructed so as to be rugged and maintenance free.

Another object of the present invention is to provide a novel and improved angle cap electrical wiring connector device having a cable clamping mechanism which overcomes the disadvantages and undesirable characteristics of previously known angle cap electrical connector devices.

Objects and advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, arrangements, combinations and improvements herein shown and described.

SUMMARY OF THE INVENTION

Briefly described, the present invention is directed to a new and improved angle cap construction in which the cable clamp is removably fixedly mounted to the angle cap housing independent of the clamp tightening screws, and in which an expandable diaphragm member extends between the wiring chamber cavity and the cable clamp so as to cover the wiring chamber for all clamping positions of the cable clamp.

As preferably embodied, the cable clamp and diaphragm member are formed as an integral, one piece insert member adapted to be slidably telescopically received and lockably removably held in place in the angle cap housing.

The cable clamp and diaphragm member of the invention includes a clamp member, an arcuate section adapted to be slidably received in a correspondingly-sized arcuate opening in the wall of the angle cap forming the wiring chamber cavity and a flexible, elongated sheet extending between and joined at its opposite ends to each of the aforesaid clamp member and arcuate section. Guide lugs and locking leg members extending laterally outwardly from the arcuate section and clamping member are telescopically slidably lockably received in channels formed in the angle cap housing on opposite sides of a cavity formed therein for receiving the electrical power cable.

It will be apparent from the foregoing general description that the objects of the invention specifically enumerated herein are accomplished by the invention as here embodied. Thus, by providing a diaphragm member extending between the wiring chamber cavity and the clamping member, the wiring chamber is covered at all times for all positions of the clamping member. By forming the clamping member and diaphragm as a single, integral piece only a single molding operation is required. Finally, by forming the clamping member and angle cap housing with suitable slidably interlocking parts, the clamp may be removably lockably mounted to the angle cap independent of the clamp tightening screws.

It will be understood that the foregoing general description and the following detailed description as well are exemplary and explanatory of the invention but are not restrictive thereof.

The accompanying drawings, referred to herein and constituting a part hereof, illustrate a preferred embodiment of the invention, and together with the description, serve to explain the principles of the invention.

DESCRIPTION OF THE PREFERRED EMBODIMENT

Figure 1:
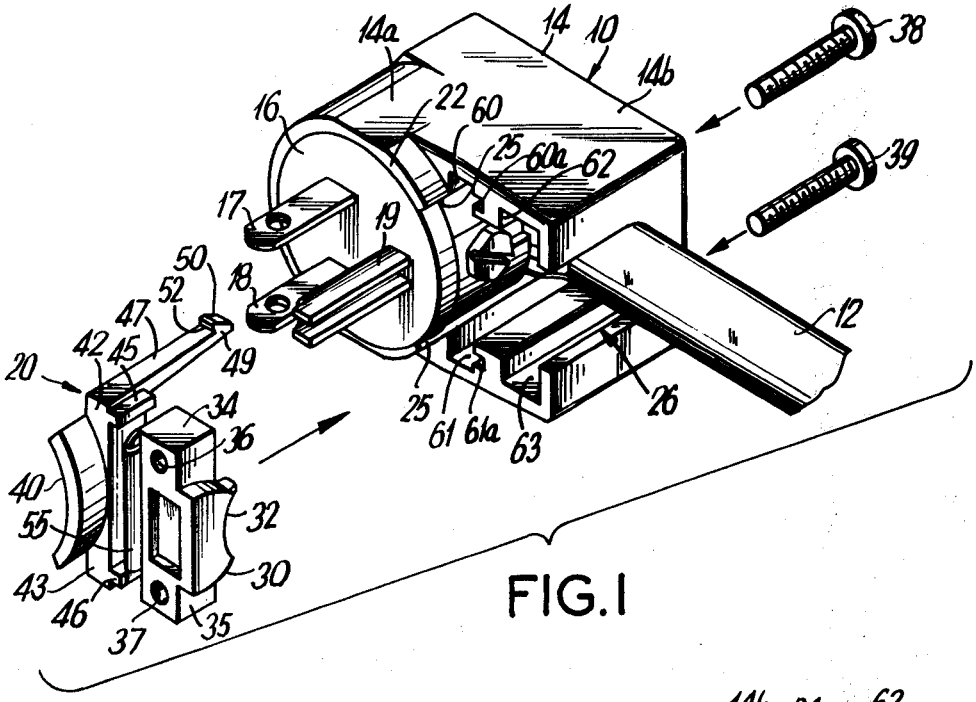
FIG. 1 is a partially exploded front perspective view of an angle cap construction embodying the present invention, with the cable clamp and diaphragm insert member and the clamp tightening screws drawn out from their assembled position so as to illustrate assembly of the device.

Referring now more particularly to the embodiment of the invention shown in the accompanying drawings, there is illustrated an electrical wiring connector device, known commercially as an "angle cap" or angle plug, indicated generally by reference numeral 10, connected to a suitable electrical power cable 12.

Angle cap 10 includes a body 14 comprised of a generally circular portion 14*a*, housing a suitable conventional wiring chamber 16, which typically includes a pair of power contact blades 17, 18 and a grounding prong 19 to which the electrical wires of cable 12 are connected in conventional manner, and a generally rectangular portion 14*b* projecting laterally from circular portion 14*a*, which houses cable clamp means, more fully described hereinafter, for engaging and clamping cable 12 to the angle cap housing.

Figure 5:
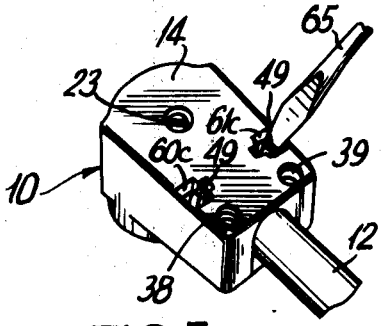
FIG. 5 is a rear perspective view of the angle cap of FIG. 1 in assembled condition, illustrating the procedure for removal of the cable clamp and diaphragm insert member from the angle cap housing.

Advantageously, the angle cap body portion 14*a* defines a circular cavity 22 adapted to slidably telescopically receive a conventional circular wiring chamber 16 therein. A self-threading fastening screw 23 (see FIG. 5) also advantageously extends through an aperture in the back of the cap body 14 and into threaded engagement with a central borehole in the wiring chamber (not shown) to secure the latter in place in angle cap 10.

Circular cavity 22 is provided with an open arcuate section 25 communicating cavity 22 with a generally rectangular cavity 26 defined by the angle cap body portion 14*b*. Cavity 26 is adapted to receive the electrical cable 12 therethrough and open arcuate section 25 permits electrical connection between cable 12 and wiring chamber 16.

Also advantageously, but not shown in the drawings, the respective outer and inner circumferentially extending surfaces of wiring chamber 16 and cavity 22 may be provided with a series of suitable opposed mating splines and grooves so as to permit the blades and grounding prong 17, 18 and 19, respectively, to be indexed into a variety of angular positions with respect to the electrical cable 12, as is conventionally known in the art.

In accordance with the invention, cable clamp means is provided which is removably fixedly mounted to the angle cap body 14 independently of the clamp tightening devices. Also in accordance with the invention, means are provided for closing access to the wiring chamber 16 during all clamping positions of the clamp member.

To this end, as preferably embodied, there is provided a one piece, integrally formed cable clamping and expandable diaphragm insert member 20 adapted to be slidably removably fixedly mounted to the angle cap body 14.

Insert member 20 includes, at one end, a clamping member 30 having suitable clamping teeth 32 for engaging electrical power cable 12 and opposed laterally outwardly extending lugs 34, 35 containing boreholes 36, 37, respectively, adapted to receive self-threading clamp tightening screws 38, 39. Lugs 34, 35 guide teeth 32 into and out of clamping engagement with cable 12, as is more fully described hereinafter.

The opposite end of insert member 20 is formed as an arcuate section 40, adapted to register with the arcuate opening 25 in portion 14*a* of the angle cap body so as to complete the circular cavity 22 adjacent the front outer edge thereof. A further set of opposed guide lugs 42, 43 extend laterally outwardly adjacent the ends of arcuate section 40, each lug including a stop flange 45, 46, respectively, and a depending leg 47, 48. Legs 47, 48 diverge slightly outwardly from one another, each terminating in a thickened foot 49 having an inclined face 50 so as to form a shoulder 52 adjacent the outer facing surfaces of legs 47, 48. Legs 47, 48 are relatively thin and formed from a suitable material so as to be flexible and resilient so that the foot portions 49 serve to lock the insert member 20 in place in the angle cap body 14 by a "snap-in" action, more fully described hereinafter.

Figure 2:
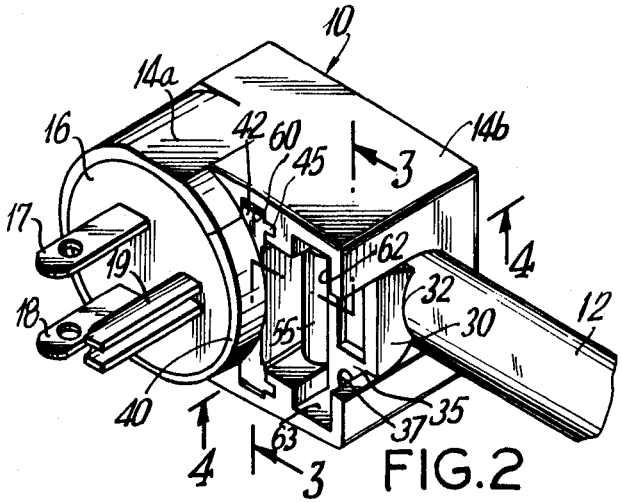
FIG. 2 is a front perspective view of the angle cap of FIG. 1 in assembled condition and in clamping engagement with an electrical power cable.
Figure 3:
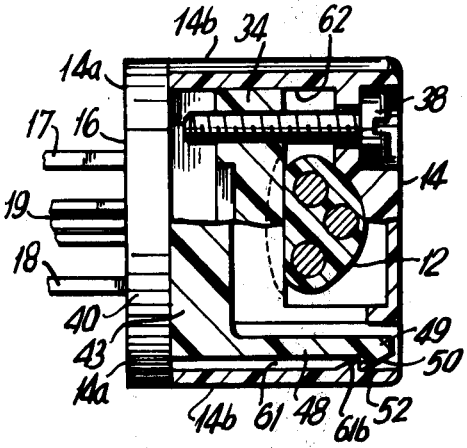
FIG. 3 is a sectional view taken along line 3—3 of FIG. 2.
Figure 4:
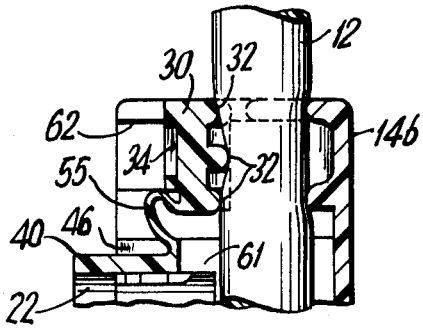
FIG. 4 is a sectional view, partly in elevation, taken along line 4—4 of FIG. 2.

Finally, end portions 30 and 40 of insert member 20 are connected by a relatively thin sheet of flexible material 55, forming a diaphragm member which may be folded up in accordion-like fashion, as shown in FIG. 1, or elongated to accommodate movement of clamping member 30 into clamping engagement with cable 12, as shown in FIGS. 2 and 4.

Angle cap body portion 14*b* includes first and second pairs of opposed channel-like open slots 60, 61 and 62, 63, respectively, facing rectangular cavity 26, which are adapted to slidably telescopically receive guide lugs 34, 35 and 42, 43 of insert member 20, respectively. Slots 60, 61 include additional interior slots 60*a*, 61*a*, respectively, for receiving the length of flanges 45, 46 only, thus providing a stop against continued inward movement of insert 20 into the cap body portion 14*b*. Channel slots 60, 61 also include inwardly inclined portions adjacent the ends thereof at the back of the cap body, such as shown at 61*b*, forming a shoulder adapted to face shoulder 52 of legs 47, 48 when insert member 20 is mounted in place.

It will be apparent from the foregoing that the angle cap constructed in accordance with the invention is assembled by first connecting cable 12 to wiring chamber 16 in the desired position of angular orientation therebetween, thereafter telescopically slidably inserting chamber 16 in cavity 22 and simultaneously placing cable 12 in cavity 26 and then tightening central screw 23 to secure wiring chamber 16 to the angle cap housing. Insert clamp and diaphragm member 20 is thereafter installed by simultaneously telescopically slidably inserting arcuate section 40 into arcuate opening 25, legs 47, 48 into slots 60, 61, respectively, and lugs 34, 35 into slots 62, 63, respectively. Legs 47, 48 continue to slide into slots 60, 61 until flanges 45, 46 come to rest against the bottom of the interior slots 60*a*, 61*a*, at which time foot portions 49 are deflected past inclined abutments 60*b* (not shown), 61*b* and shoulders 52 are in locking engagement with the shoulders of abutments 60*b*, 61*b*. Screws 38, 39 are then inserted into boreholes 36, 37 and suitably tightened to draw clamp 30 into secure engagement with cable 12. As clamp 30 is drawn down into clamping engagement with cable 12, diaphragm 55 unrolls, or expands, thereby automatically adjusting to all cable diameters while continuing to cover the wiring chamber.

Insert member 20 may be removed from the angle cap body 14 by simply pressing the foot portions 49 of legs 47, 48 inwardly by a suitable tool, such as screwdriver 65 or the like, from the back of the cap body, so as to deflect shoulders 52 past abutments 60*b*, 61*b*. Advantageously, the ends of slots 60, 61 opening to the back of angle cap housing 14 are of enlarged width, as shown at 60*c*, 61*c*, so as to permit a standard screwdriver to be inserted into the slots against feet 49.

While the foregoing description of the single cap construction embodying the present invention has been directed to a circular cavity 22 and to an arcuate opening 25 therein adapted to receive an arcuate portion 40 formed on insert member 20, it will be understood that the invention is not limited to such shapes, but that cavity 22 may also be e.g., square or rectangular in shape and that opening 25 and section 40 may also suitably be of other shapes, e.g., square, rectangular or triangular. Also, it will be understood that the invention is not limited to an insert member which is removably fixedly mounted in place in the angle cap housing, as the diaphragm and clamp member may be formed as an integral extension of the front portion of the wiring chamber cavity wall with equally satisfactory results.

While it also will be understood from the foregoing description that neither the angle cap housing nor the cable clamp and diaphragm insert member of the invention are in any way limited to the use of particular materials, they are preferably formed from molded thermoplastic resin materials.

With respect to the materials from which each of the angle cap body and insert members are formed, certain injection moldable thermoplastic resin materials have been found to produce highly satisfactory results and are given as an example of the preferred mode of carrying out the invention, from which other equivalent materials will be apparent to those of ordinary skill in the art. Thus, it has been found that the polycarbonate resin material sold by the General Electric company under the trade name "LEXAN", Grades 103 or 123, is a particularly preferred material for the angle cap body from the standpoint of strength and high temperature resistance. It has been found that a nylon resin material, such as sold by the E. I. DuPont de Nemours company under the trade name "ZYTEL", Grade 101, is a particularly preferred material for the cable clamp and diaphragm insert member. Polypropylene resin materials also operate satisfactorily for the insert member.

Thus, the invention in its broader aspects is not limited to the specific embodiment herein shown and described but departures may be made therefrom within the scope of the accompanying claims, without departing from the principles of the invention and without sacrificing its chief advantages.

What is claimed is:

1. An electrical angle cap wiring connector comprising:

an angle cap housing member defining a first front-opening cavity adapted to slidably telescopically receive a wiring chamber therein and a second front-opening and open-ended cavity adapted to receive an end portion of an electrical power cable therein, said first and second housing cavities communicating interiorly of said housing so as to permit connection between said wiring chamber and said cable;

said wiring chamber having a front face from which electrical contact elements extend at a right angle to the direction in which said cable extends out of said open end of said second cavity defined by said housing, said wiring chamber front face forming a portion of the front face of said angle cap housing;

a single clamp member adapted to engage and clamp said cable to said angle cap housing; and flexible and easily expandable cover means extending continuously between said clamp member and said first cavity defined by said angle cap housing, said flexible cover means and said clamp member forming the remaining portion of the front face of said angle cap housing, whereby said angle cap wiring connector is continuously closed along the front face thereof from said wiring chamber to said cable clamp member for all sizes of electrical power cable connected to said connector.

2. An electrical angle cap wiring connector as claimed in claim 1, wherein said cover means is expandable so as to automatically adjust upon tightening of said clamp means, thereby providing said angle cap housing with a continuous front closure for all electrical power cable sizes.

3. An electrical angle cap wiring connector as claimed in claim 1, including means removably fixedly mounting said cable clamp means to said angle cap housing independent of means for tightening said clamp means onto said cable.

4. An electrical angle cap wiring connector as claimed in claim 1, wherein said clamp means and said cover means are formed as a single, integral member.

5. In an electrical wiring connector device housing an end portion of an electrical power cable and a wiring chamber including electrical power contact blades to which the cable is connected, and including clamp means and clamp tightening means for clamping said cable to the connector housing, the improvement therein which comprises:

means removably fixedly mounting said cable clamp means to said connector housing independent of said clamp tightening means;

cover means extending continuously between the portion of said connector device housing said wiring chamber and said cable means, said cover means adapted to continuously close access to said wiring chamber from the outside of said connector device for all sizes of electrical power cable connected thereto;

said connector housing includes an elongated open channel portion comprising an access port for said cable;

said elongated channel includes opposed first slot means facing the cable channel;

said clamp means includes a first pair of opposed guide lugs adapted to be telescopically slidably received in said first slot means; and said clamp tightening means comprises a pair of screws extending through said connector housing and into threaded engagement with said guide lugs.

6. A connector device as claimed in claim 5, wherein said connector housing includes opposed second slot means facing said cable channel, said cable clamp means includes a second pair of opposed guide lugs adapted to be telescopically slidably received in said second slot means, and a pair of flexible leg members depending from said second pair of guide lugs adapted to slidably lock in place adjacent one end of said second slot means.

7. A connector device as claimed in claim 6, wherein said second slot means includes shoulder means, said flexible leg members terminate in laterally outwardly extending foot portions which are adapted to slide past and thereafter engage said shoulder means, and including stop means adapted to stop movement of said second pair of guide lugs and depending legs into said second slot means when said foot portions are in engagement with said shoulder means, thereby slidably locking said clamp means to said connector housing.

8. A connector device as claimed in claim 7, wherein said second slot means are open at each of the front and back ends thereof and said foot portions are accessible from the back side of said connector housing when in locking engagement with said shoulder means, whereby said leg members may be released from locking engagement with said connector housing by applying lateral pressure to said foot portions from the back side of said connector housing.

9. A connector device as claimed in claim 8, wherein said connector housing is formed from an injection moldable thermoplastic resin material.

10. A connector device as claimed in clain 9, wherein said connector housing is molded from a polycarbonate resin material.

11. In an electrical wiring connector device housing an end portion of an electrical power cable and a wiring chamber including electrical power contact blades to which the cable is connected, and including clamp means and clamp tightening means for clamping said cable to the connector housing, the improvement therein which comprises:

means removably fixedly mounting said cable clamp means to said connector housing independent of said clamp tightening means;

cover means extending continuously between the portion of said connector device housing said wiring chamber and said cable clamp means, said cover means adapted to continuously close access to said wiring chamber from the outside of said connector device for all sizes of electrical power cable connected thereto; and wherein said cover means is expandable so as to close access to said wiring chamber for all clamping positions of said clamp means.

12. In an electrical wiring connector device housing an end portion of an electrical power cable and a wiring chamber including electrical power contact blades to which the cable is connected, and including clamp means and clamp tightening means for clamping said cable to the connector housing, the improvement therein which comprises:

means removably fixedly mounting said cable clamp means to said connector housing independent of said clamp tightening means;

cover means extending continuously between the portion of said connector device housing said wiring chamber and said cable clamp means, said cover means adapted to continuously close access to said wiring chamber from the outside of said connector device for all sizes of electrical power cable connected thereto; and said cover means comprises a flexible sheet member adapted to fold up in accordion-like fashion and to stretch out into a relatively flat sheet so as to automaticaly adjust as said clamping means is adjusted to different electrical power cable sizes and thereby continuously close access to said wiring chamber.

13. In an electrical wiring connector device housing an end portion of an electrical power cable and a wiring chamber including electrical power contact blades to which the cable is connected, and including clamp means and clamp tightening means for clamping said cable to the connector housing, the improvement therein which comprises:

means removably fixedly mounting said cable clamp means to said connector housing independent of said clamp tightening means;

cover means extending continuously between the portion of said connector device housing said wiring chamber and said cable clamp means, said cover means adapted to continuously close access to said wiring chamber from the outside of said connector device for all sizes of electrical power cable connected thereto; and said cover means, said cable clamp means and said means removably fixedly mounting said cable clamp means to said connector housing are formed as a single, integral member.

14. A connector device as claimed in claim 13, wherein said single, integral member is formed from an injection moldable thermoplastic resin material.

15. A connector device as claimed in claim 14, wherein said single, integral member is formed from nylon.

16. A connector device as claimed in claim 14, wherein said single, integral member is formed from polypropylene.

* * * * *